US008922323B2

(12) United States Patent
Uozumi et al.

(10) Patent No.: US 8,922,323 B2
(45) Date of Patent: Dec. 30, 2014

(54) OUTER CORE MANUFACTURING METHOD, OUTER CORE, AND REACTOR

(75) Inventors: Masato Uozumi, Itami (JP); Atsushi Sato, Itami (JP); Kazushi Kusawake, Itami (JP)

(73) Assignees: Sumitomo Electric Industries, Ltd., Osaka (JP); Sumitomo Electric Sintered Alloy, Ltd., Okayama (JP)

( * ) Notice: Subject to any disclaimer, the term of this patent is extended or adjusted under 35 U.S.C. 154(b) by 0 days.

(21) Appl. No.: 13/812,997

(22) PCT Filed: Feb. 9, 2012

(86) PCT No.: PCT/JP2012/052942

§ 371 (c)(1),
(2), (4) Date: Jan. 29, 2013

(87) PCT Pub. No.: WO2012/132565

PCT Pub. Date: Oct. 4, 2012

(65) Prior Publication Data

US 2013/0127574 A1 May 23, 2013

(30) Foreign Application Priority Data

Mar. 30, 2011 (JP) ..... 2011-075738
Aug. 23, 2011 (JP) ..... 2011-181631

(51) Int. Cl.
*H01F 27/24* (2006.01)
*H01F 27/28* (2006.01)

(Continued)

(52) U.S. Cl.
CPC ..... *H01F 41/02* (2013.01); *H01F 1/24* (2013.01); *H01F 27/255* (2013.01);

(Continued)

(58) Field of Classification Search
USPC ..... 336/212, 178, 184, 233; 419/64, 66, 38; 29/602.1
See application file for complete search history.

(56) References Cited

U.S. PATENT DOCUMENTS 3,566,323 A * 2/1971 Chant et al. ..... 336/233

(Continued)

FOREIGN PATENT DOCUMENTS

JP 4-168201 A 6/1992
JP 05-036546 A * 2/1993

(Continued)

OTHER PUBLICATIONS

International Search Report for PCT/JP2010/052942 mailed May 22, 2012.

(Continued)

*Primary Examiner* — Mangtin Lian
(74) *Attorney, Agent, or Firm* — Ditthavong & Steiner, P.C.

(57) ABSTRACT

When an outer core that is to be mounted on a reactor is seen in plan, the outer core is a compact that has a plan-view shape in which a side of the outer core that is opposite to a facing side of the outer core, which faces the inner cores, has a smaller dimension in a width direction, which is parallel to a facing surface, than the facing side of the outer core. A method of manufacturing such an outer core includes a preparing step and a compacting step. In the preparing step, coated soft magnetic powder including multiple coated soft magnetic particles formed by coating soft magnetic particles with insulating coated films is prepared as raw-material powder of the outer core. In the compacting step, a compacting space 31, which is defined by a pillar-like lower punch 12 and a tubular die 10A, is filled with the coated soft magnetic powder and then the coated soft magnetic powder in the compacting space 31 is compacted by the lower punch 12 and a pillar-like upper punch 11, the lower punch 12 and the tubular die 10A being movable relative to each other. In the compacting step, the facing surface of the outer core is pressed by the upper punch 11.

9 Claims, 8 Drawing Sheets

(51) Int. Cl.

| | |
|---|---|
| ***B22F 1/00*** | (2006.01) |
| ***B22F 3/02*** | (2006.01) |
| ***H01F 7/06*** | (2006.01) |
| ***H01F 41/02*** | (2006.01) |
| ***H01F 1/24*** | (2006.01) |
| ***H01F 27/255*** | (2006.01) |
| ***H01F 37/00*** | (2006.01) |
| ***H01F 27/00*** | (2006.01) |

(52) U.S. Cl.

CPC ..... *H01F 37/00* (2013.01); *H01F 27/00* (2013.01); *H01F 41/0246* (2013.01)

USPC ..... 336/212; 336/233; 336/184; 419/64; 419/66; 29/602.1

(56) References Cited

U.S. PATENT DOCUMENTS

| | | | | |
|---|---|---|---|---|
| 7,608,968 | B2 * | 10/2009 | Toyoda et al. | 336/130 |
| 2009/0144967 | A1 * | 6/2009 | Hasu et al. | 29/605 |
| 2010/0319802 | A1 * | 12/2010 | Hattori | 140/71 C |
| 2010/0321145 | A1 * | 12/2010 | Kaoru et al. | 336/222 |
| 2011/0025444 | A1 * | 2/2011 | Sugiyama et al. | 336/212 |
| 2011/0156853 | A1 * | 6/2011 | Kato et al. | 336/192 |
| 2012/0126928 | A1 * | 5/2012 | Yoshikawa et al. | 336/221 |

FOREIGN PATENT DOCUMENTS

| | | | |
|---|---|---|---|
| JP | 6-55297 | A | 3/1994 |
| JP | 2000-144211 | A | 5/2000 |
| JP | 2008-160020 | A | 7/2008 |
| JP | 4524805 | B1 | 8/2010 |
| JP | 2010-272772 | A | 12/2010 |
| WO | 2009/115916 | A1 | 9/2009 |
| WO | WO2010/021113 | A1 * | 2/2010 |
| WO | 2010/110007 | A1 | 9/2010 |

OTHER PUBLICATIONS

Extended European Search Report for corresponding European Application No. 12765517.3, dated Jul. 31, 2013, 4 pages.

* cited by examiner

OUTER CORE MANUFACTURING METHOD, OUTER CORE, AND REACTOR

TECHNICAL FIELD

The present invention relates to an outer core manufacturing method by which, as a component of a reactor that includes a coil and an annular core, an outer core that is exposed outside the coil and constitutes part of the annular core is manufactured, and also relates to an outer core manufactured by the manufacturing method and a reactor including the outer core. Particularly, the present invention relates to a method of manufacturing an outer core that is effective in reducing loss in a reactor.

BACKGROUND ART

Hybrid cars or other devices include a booster circuit in a system for supplying power to a motor. A reactor is used as a component of the booster circuit. An example of such a reactor is disclosed in Patent Literature 1.

As illustrated in FIG. 7, the reactor disclosed in Patent Literature 1 includes a coil 105, inner cores 101*c* disposed inside the coil 105, and outer cores 101*e* disposed so as to be exposed outside the coil 105. More specifically, as illustrated in FIG. 8, the coil 105 is constituted by a pair of coil elements 105*a* and 105*b* that are connected to each other and arranged side by side, the coil elements 105*a* and 105*b* being formed by helically winding a wire 105*w*. The inner cores 101*c* are pillars each having a rectangular cross section and are individually disposed inside the coil elements 105*a* and 105*b*. The outer cores 101*e* are exposed outside the coil 105 and are pillars of a substantially trapezoidal (trapezoid-like) shape having upper and lower bases. The outer cores 101*e* face end surfaces of the inner cores 101*c* to form an annular core. These components are integrated from the left and right sides of FIG. 8 so as to form a reactor 100 illustrated in FIG. 7.

The outer core 101*e* is made of coated soft magnetic powder, which includes multiple soft magnetic particles formed by coating soft magnetic particles with insulating coated films, as raw-material powder and formed by compacting the raw-material powder. Generally, compacting is performed by filling a compacting space, which is defined by a pillar-like first punch and a tubular die, with coated soft magnetic powder and compressing the coated soft magnetic powder in the compacting space by using the first punch and a pillar-like second punch, the first punch and the die being movable relative to each other. At this time, the coated soft magnetic powder is compressed so that the first punch and the second punch form upper and lower surfaces of an outer core. This is because compacting of a dust compact is generally performed by compressing raw-material powder such that the obtained compact has a uniform cross section when taken in a direction orthogonal to the pressure-application direction.

CITATION LIST

Patent Literature

PTL 1: Japanese Unexamined Patent Application Publication No. 2010-272772

SUMMARY OF INVENTION

Technical Problem

In the outer core manufactured in the above manner, the insulating coated films of the coated soft magnetic particles located on an outer surface of the outer core, the outer surface being surrounded by the die, or on a surface extending parallel with the pressure-application direction (that is perpendicular to the magnetic flux direction) may be damaged by pressure applied thereto in the compacting operation or by being rubbed by the die when the compact is removed from the die. If the insulating coated films are damaged, the soft magnetic particles may be exposed and flatly extended. This may cause the soft magnetic particles in the dust compact to conduct electricity between one another to form a substantially film-like electrically conductive portion, which leads to an increase in eddy current loss. Consequently, the magnetic properties of the outer core may deteriorate.

The present invention is made in view of the above circumstances and an object of the present invention is to provide an outer core manufacturing method by which an outer core that is effective in reducing loss in a reactor can be manufactured.

Another object of the present invention is to provide an outer core manufactured by the manufacturing method according to the present invention.

Another object of the present invention is to provide a low-loss reactor.

Solution to Problem

The present invention achieves the above objects by applying pressure in a specific pressure-application direction to form an outer core, or by applying pressure to a specific surface of a dust compact. Specifically, the coated soft magnetic powder is compressed in such a direction as to form a compact having an uneven cross section when taken in a direction orthogonal to the pressure-application direction.

An outer core manufacturing method according to the present invention is a method of manufacturing an outer core that is to be mounted on the following reactor by performing compacting. The reactor includes a coil, a pair of inner cores, and a pair of outer cores. More specifically, the coil is formed by connecting a pair of coil elements to each other that are arranged side by side, the coil elements being formed by helically winding a wire. The pair of inner cores are individually disposed inside the coil elements. The pair of outer cores are exposed outside the coil and are connected to the inner cores to form an annular core together with the inner cores. The outer cores each have a facing surface that includes a connection area connected to the inner cores. The facing surface of one of the outer cores faces the other outer core with the inner cores interposed therebetween. Each of the outer cores has a plan-view shape, when seen in plan in a direction of an axis of the annular core, in which a side of the outer core that is opposite to a facing side of the outer core, which faces the inner cores, has a smaller dimension in a width direction, which is parallel with the facing surface, than the facing side of the outer core. The manufacturing method is one by which the outer core is manufactured and includes a preparing step and a compacting step. In the preparing step, coated soft magnetic powder including multiple coated soft magnetic particles formed by coating soft magnetic particles with insulating coated films is prepared as raw-material powder of the outer core. In the compacting step, a compacting space, which is defined by a pillar-like first punch and a tubular die, is filled with the coated soft magnetic powder and then the coated soft magnetic powder in the compacting space is compacted by the first punch and a pillar-like second punch that is disposed so as to face the first punch, the first punch and the tubular die being movable relative to each other. In the compacting step, the facing surface of the outer core is pressed by the second punch.

By the manufacturing method according to the present invention, an outer core that is effective in reducing loss in a reactor can be manufactured. Applying pressure to a surface that is to be the facing surface in the compacting step prevents the surface from being rubbed by the die in the pressure applying step or removing step. Thus, the insulating coated films of the coated soft magnetic powder on the facing surface are less likely to be damaged and thus an electrically conductive portion in which the soft magnetic particles conduct electricity between one another is less likely to be formed on the facing surface. The facing surface includes connection areas that are connected to the inner cores, and the connection areas serve as linkage surfaces through which fluxes pass substantially orthogonally to the surfaces when a reactor is assembled and the coil is excited. In other words, since an electrically conductive portion is less likely to be formed on the facing surface, an eddy current is less likely to occur over the connection areas, and thereby an eddy current loss can be reduced.

An aspect of the manufacturing method according to the present invention is characterized in that the soft magnetic particles are made of pure iron.

By the method described above, an outer core that is effective in reducing loss in a reactor can be manufactured notwithstanding the soft magnetic particles being made of pure iron. Since pure iron is soft, pure iron is easily deformed when being compacted. Particularly, when the coated soft magnetic powder is pressed or when the compact is removed from the die, the insulating coated films are more likely to be damaged by being rubbed by the die. This makes it more likely that the electrically conductive portion will be formed and that a loss will increase. However, application of pressure to a surface that is to be the facing surface makes it less likely that an electrically conductive portion will be formed on the facing surface and that an eddy current will occur over the facing surface. Consequently, an outer core that can reduce a loss in a reactor can be manufactured by the above-described method, notwithstanding the soft magnetic particles being made of pure iron.

As an aspect of the manufacturing method according to the present invention, the plan-view shape of the outer core is any one of (A) a bow shape in which the facing side of the outer core, which faces the inner cores, serves as a chord and the side of the outer core that is opposite to the facing side serves as an arc;

(B) a trapezoidal shape in which the facing side of the outer core, which faces the inner cores, serves as a longer base; and (C) a U shape that opens to the facing side of the outer core, which faces the inner cores.

By the above-described method, an outer core that is effective in reducing loss in a reactor can be manufactured regardless of which of the above plan-view shapes the outer core has. Examples of the bow shape here include a substantially bow-like shape having a chord and an arc, as well as a bow shape constituted only by a chord and an arc. Specifically, examples of the substantially bow-like shape include a shape in which an arc is partially cut so as to have a side parallel with a chord, and a shape that includes a protrusion that protrudes from a portion of a chord toward the side that is opposite to the facing side. Likewise, the trapezoidal shape or the U shape also includes substantially trapezoidal or U-like shapes. Specifically, examples of the trapezoidal shape include a substantially trapezoidal shape that has a longer base and a shorter base, as well as a trapezoidal shape having a longer base and a shorter base opposite to the longer base. More specifically, an example of the substantially trapezoidal shape is a shape that includes a protrusion protruding from the shorter base of a trapezoid. The U shape includes a substantially U-like shape that has an opening, as well as the U shape that opens to the facing side. More specifically, examples of the substantially U-like shape include a shape in which a portion on a side opposite to the opening side is partially cut so that a side parallel with the connection areas is formed, and a shape that includes a protrusion protruding from the cut portion on the side opposite to the opening side toward the side opposite to the opening side. Each protrusion may have a shape that extends uniformly toward the side opposite to the opening side, or a shape in which the width of the protrusion tapers from the facing-surface side toward the opposite-surface side. Examples of the shape of the protrusion include a polygon, such as a rectangle, a bow, and a semicircle.

As an aspect of the manufacturing method according to the present invention, the plan-view shape of the outer core further includes at least one of:

(D) a facing-surface-side rectangular portion in which an area of the facing surface parallel with a pressure-applying surface of the second punch serves as a long side of the facing-surface-side rectangular portion; and (E) an opposite-side rectangular portion in which a surface that is opposite to and parallel with the facing surface serves as a long side of the opposite-side rectangular portion.

By the above-described method, when an outer core that includes the facing-surface-side rectangular portion is manufactured, a distance equivalent to the thickness of the compacted facing-surface-side rectangular portion is left between the second punch and portions of the inner circumference of the die, the portions being not orthogonal to the pressure-applying surface of the second punch at the time of pressure application. Consequently, the second punch is prevented from abutting against the portions that are not orthogonal to the pressure-applying surface, and thereby the die and the second punch are prevented from being damaged. In addition, by the above-described method, an outer core having a high density can be more easily manufactured than in the case of a method of manufacturing an outer core including no facing-surface-side rectangular portion since maximum pressure can be applied to the coated soft magnetic powder. Moreover, by the above-described method, easily breakable acute corners are prevented from being formed at both ends in the width direction of the facing surface of the outer core.

On the other hand, when an outer core including the opposite-side rectangular portion is manufactured, a distance equivalent to the thickness of the compacted opposite-side rectangular portion is left between the first punch and a portion of the die at the time of pressure application. Consequently, the first punch is prevented from relatively entering the inner side (second-punch side) of the die beyond a predetermined position. This prevents easily breakable acute corners from being formed at both ends in the width direction of the surface that is opposite to the facing surface of the outer core by the first punch entering the inner side (second-punch side) of the die.

As an aspect of the manufacturing method according to the present invention, when the outer core includes at least the facing-surface-side rectangular portion, a thickness of the facing-surface-side rectangular portion is 0.3 mm or larger but not larger than 2.0 mm.

By the above-described method, by manufacturing an outer core that has the facing-surface-side rectangular portion whose thickness is 0.3 mm or larger, the second punch is fully prevented from abutting against the portions of the inner circumference of the die, the portions being not orthogonal to the pressure-applying surface of the second punch at the time of pressure application. On the other hand, by manufacturing an outer core that has the facing-surface-side rectangular portion whose thickness is 2.0 mm or smaller, an area on the facing-surface side in which the coated soft magnetic powder is rubbed by the die in the pressure applying step or the removing step can be reduced, the facing-surface side being a side that is closer to the coil when a reactor is assembled. This can prevent the insulating coated films from being damaged and thereby an eddy current loss can be reduced.

An aspect of the manufacturing method according to the present invention is characterized in that, when the outer core includes at least the opposite-side rectangular portion, a thickness of the opposite-side rectangular portion is 0.5 mm or larger but not larger than t/2 where t denotes a distance from the facing surface of the outer core to the surface of the outer core opposite to the facing surface.

By the above-described method, by manufacturing an outer core that has the opposite-side rectangular portion whose thickness is 0.5 mm or larger, the first punch is fully prevented from relatively entering the inner side (second-punch side) of the die to an excessive extent at the time of pressure application. On the other hand, by manufacturing an outer core that has the opposite-side rectangular portion whose thickness is t/2 or smaller, the ratio of the opposite-side rectangular portion to the entirety of the outer core is kept from being excessively large.

As an aspect of the manufacturing method according to the present invention, in the plan-view shape of the outer core that includes both the facing-surface-side rectangular portion and the opposite-side rectangular portion, a thickness of the facing-surface-side rectangular portion is smaller than a thickness of the opposite-side rectangular portion.

In the above configuration, by making the thickness of the facing-surface-side rectangular portion smaller, the area in the outer core that is rubbed by the die can be reduced, thereby preventing an eddy current from occurring in a direction of the circumference of the facing-surface-side rectangular portion. Consequently, an outer core that is effective in reducing loss in a reactor can be manufactured.

The outer core according to the present invention is manufactured by the outer core manufacturing method according to the present invention.

In the outer core according to the present invention, an eddy current is less likely to occur over the facing surface, and the outer core is thus preferably applicable to a reactor. An eddy current is less likely to occur over the facing surface in the outer core according to the present invention because at least part of the facing surface containing no electrically conductive portion is connected to end surfaces of inner cores when a reactor is assembled. Thus, the outer core according to the present invention is effective in reducing a loss in a reactor.

A reactor according to the present invention includes a coil, inner cores, and outer cores. The coil is formed by connecting a pair of coil elements to each other that are arranged side by side, the coil elements being formed by helically winding a wire. The inner cores are individually disposed inside the coil elements. The outer cores are exposed outside the coil. Each outer core includes a facing surface on a side that faces the inner cores. The outer cores form an annular core together with the inner cores. Each outer core is the outer core according to the present invention.

The reactor according to the present invention includes outer cores in which an eddy current is less likely to occur on the facing surfaces that face the inner cores, and thus the reactor involves low loss.

Advantageous Effects of Invention

By the outer core manufacturing method according to the present invention, an outer core that is effective in reducing loss in a reactor can be manufactured.

The outer core according to the present invention achieves a low-loss reactor.

The reactor according to the present invention can keep loss low.

DESCRIPTION OF EMBODIMENTS

Embodiments of the present invention will be described below. Firstly, an outer core manufacturing method by which an outer core that is effective in reducing loss in a reactor is manufactured will be described, and then an example of a reactor including the outer core will be described.

Embodiment 1

Outer Core Manufacturing Method

Figure 7:
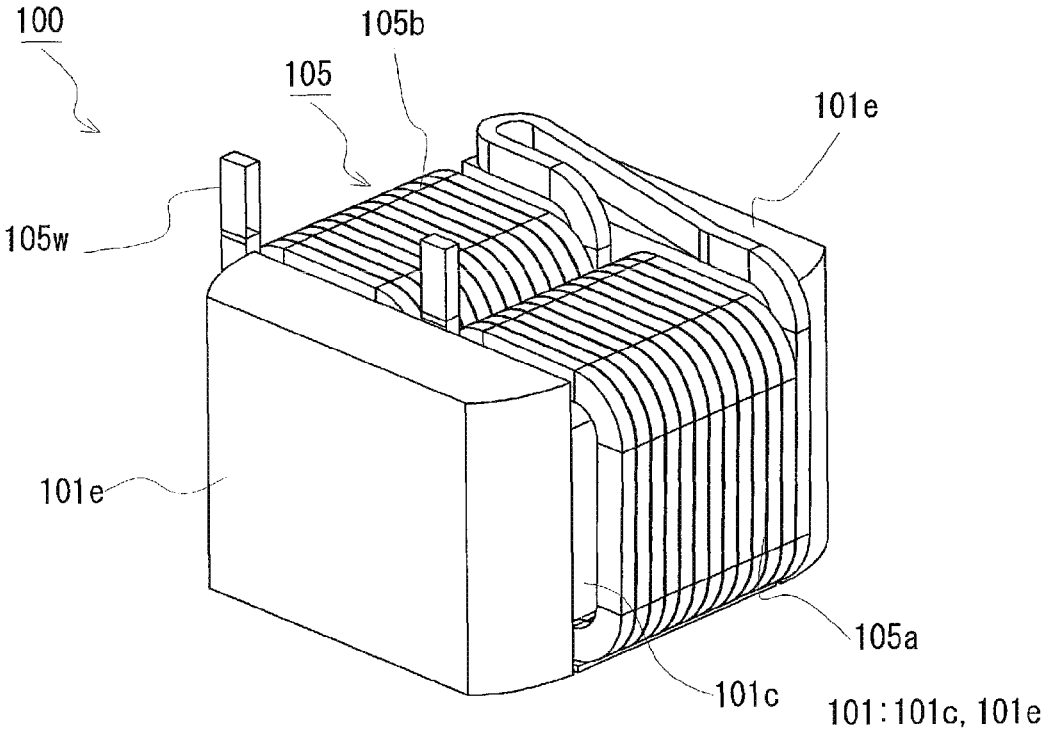
FIG. 7 is a perspective view schematically illustrating a reactor according to Embodiment 2.

An outer core manufacturing method according to the present invention is a method of manufacturing an outer core that is to be included in a reactor by performing a compacting operation. Although the details will be described below, the reactor includes a coil 105, inner cores 101*c*, and outer cores 101*e*, as illustrated in FIG. 7. Specifically, the coil 105 is formed by connecting a pair of coil elements 105*a* and 105*b* to each other that are arranged side by side, the coil elements 105*a* and 105*b* being formed by helically winding a wire 105*w*. The inner cores 101*c* are disposed individually inside the coil elements 105*a* and 105*b*. The outer cores 101*e* are exposed outside the coil 105. The outer cores 101*e* are connected to the inner cores 101*c* to form an annular core 101 together with the inner cores 101*c*. Each outer core 101*e* has a facing surface that contains connection areas, which are connected to the inner cores 101*c*, and that faces the other outer core 101*e*. The connection areas are flat areas and are positioned so as to be flush with each other. The facing surface containing the connection areas is also a flat area. When each outer core 101*e* is seen in plan in the axial direction of the annular core 101, the plan-view shape of the outer core 101*e* is one in which a side opposite to a facing-surface side of the outer core 101*e*, which faces the inner cores 101*c*, has a smaller dimension in the width direction, which is parallel with the facing surface, than the facing-surface side. The method of manufacturing this outer core 101*e* specifically includes a preparing step and a compacting step. Hereinbelow, a compacting die set that is used to manufacture an outer core will be described and then each step will be described in order.

[Compacting Die Set]

Typically, a die set used in the manufacturing method according to the present invention includes a tubular die having a through hole, and a pair of pillar-like first and second punches, which are individually insertable from opening portions of the through hole of the die. The paired first and second punches are disposed so as to face each other in the through hole. In this die set, a compacting space in the form of a closed-end cylinder is defined by one surface (a pressure-contact surface facing the other punch) of one of the punches and an inner circumference of the die. The compacting space is filled with raw-material powder, which will be described below, and the raw-material powder is pressed and compressed by the two punches to manufacture an outer core. End surfaces of the outer core are molded with the opposing surfaces of the two punches, and the outer circumference of the outer core is molded with the inner circumference of the die.

Figure 1:
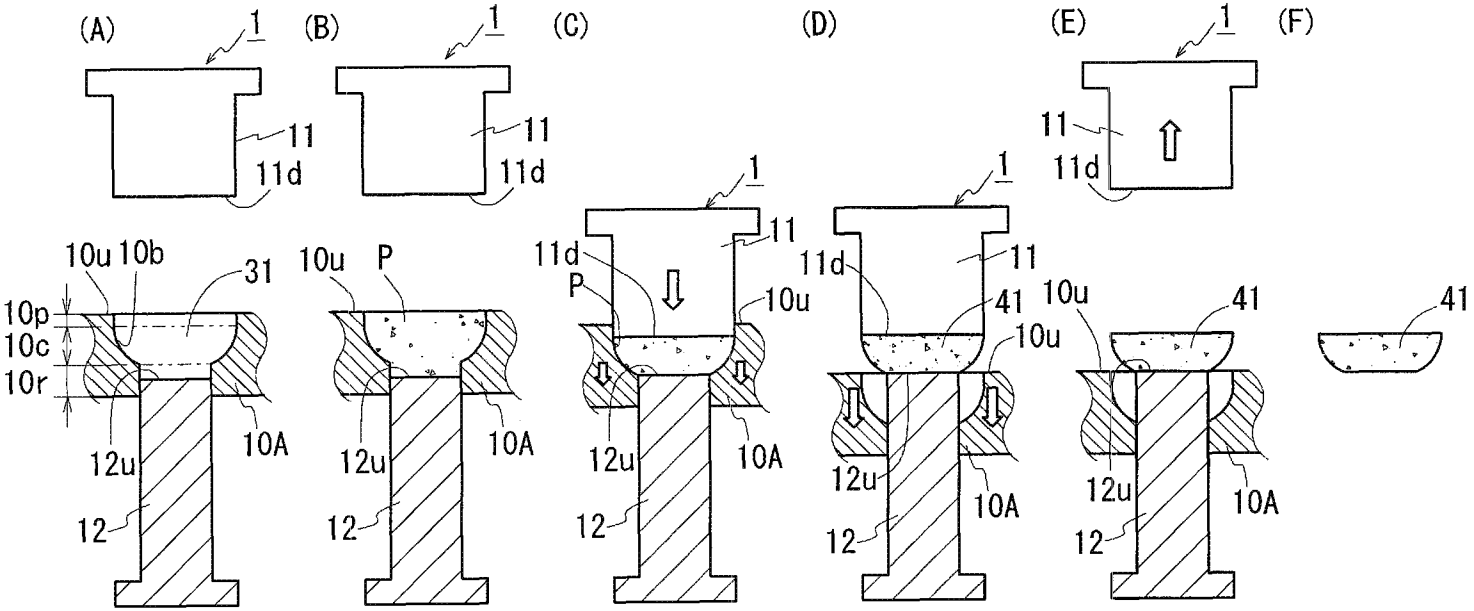
FIG. 1 illustrates a process of exemplary steps in an outer core manufacturing method according to Embodiment 1.

As illustrated in FIG. 1, a compacting die set 1, which is taken as a specific example, includes a tubular die 10A having a through hole 10*b* and a pair of pillar-like upper and lower punches 11 and 12, which are inserted into and removed from the through hole 10*b*. In FIG. 1, illustrations of the die 10A and the lower punch 12 are vertical cross sections.

(Die)

The inner circumference of the through hole in the die only has to have a vertical cross-sectional shape that corresponds to the shape of the outer core when seen in plan. For example, the through hole only has to have an inner circumferential shape in which the dimension in the width direction of the die on a first-punch side of the die is smaller than that on a second-punch side of the die. In addition, the inner circumferential shape is not particularly limited but it has to be one in which the facing surface of the outer core, which faces the inner core, can be pressed by the second punch. Specifically, the through hole in the die includes a large rectangular hole, into which the second punch is inserted, a small rectangular hole, into which the first punch is inserted, and a tapering hole, into which neither of the punches are inserted and which is formed between the large and small rectangular holes such that the dimension in the width direction of the tapering hole decreases from the large rectangular hole to the small rectangular hole. In other words, the inner circumference of the large rectangular hole is a parallel portion that is parallel with the side surfaces of the second punch, the inner circumference of the small rectangular hole is a parallel portion that is parallel with the side surfaces of the first punch, and the inner circumference of the tapering hole is a non-parallel portion that is not parallel with the side surfaces of either of the punches.

More specifically, as illustrated in part (A) of FIG. 1, an example of the inner circumferential shape includes a large rectangular hole 10*p* (facing-surface-side parallel portion) on an upper-punch-11 side of the die 10A, a small rectangular hole 10*r* (opposite-side parallel portion) on a lower-punch-12 side of the die 10A, and a tapering hole 10*c* (non-parallel portion). The upper punch 11 is inserted into the large rectangular hole 10*p*, and the lower punch 12 is inserted into the small rectangular hole 10*r*. The tapering hole 10*c* is formed between the large and small rectangular holes such that the dimension of the tapering hole 10*c* in the width direction (left-right directions of FIG. 1) of the die 10A decreases from a side closer to an top surface 10*u* (upper-punch-11 side) of the die 10A to a side closer to the lower surface (lower-punch-12 side) of the die 10A. Here, the inner circumferential shape of the tapering hole 10*c* is a substantially bow-like shape (bow shape) in which an upper-surface-10*u* side of the tapering hole 10*c* or the lower end of the large rectangular hole 10*p* serves as a chord, a lower-punch-12 side of the tapering hole 10*c* or a side closer to the upper end of the small rectangular hole 10*r* serves as an arc, and part of the arc is parallel with the chord. Here, the lower end of the large rectangular hole 10*p* refers to the boundary between the large rectangular hole 10*p* and the tapering hole 10*c*, and the upper end of the small rectangular hole 10*r* refers to the boundary between the small rectangular hole 10*r* and the tapering hole 10*c*. The thickness (up-down directions of FIG. 1) of the through hole 10*b* in the die 10A is uniform in the depth direction of the through hole 10*b* (a direction which is perpendicular to the paper, in FIG. 1). In other words, each of the rectangular holes 10*p* and 10*r* has a uniform shape in cross section when taken in a direction in which the punches 11 and 12 face each other, while the tapering hole 10*c* has a cross section such that the tapering hole 10*c* tapers from the large-rectangular-hole-10*p* side to the small-rectangular-hole-10*r* side.

(Upper Punch and Lower Punch)

The upper punch 11 and the lower punch 12 are pillars insertable into the through hole of the die. The bottom surface 11*d* of the upper punch 11 that faces the lower punch 12 has a shape that is suitable for the space formed in the die 10A. The shape of the bottom surface 11*d* of the upper punch 11 determines the shape of a facing surface of the outer core that faces the inner cores. Here, the bottom surface 11*d* of the upper punch 11 is a rectangular flat surface and the width (distance in the left-right directions of FIG. 1) of the upper punch 11 is larger than the width of the lower punch 12. A corresponding-to-upper-punch-11 surface of the compact obtained by being compacted by the upper punch 11 is a rectangular flat surface. Each of the upper punch 11 and the lower punch 12 is a single unit of a quadrangular prism shape.

A pressure-contact surface of the upper punch 11 molds the facing surface of the outer core, and a pressure-contact surface of the lower punch 12 molds an end surface of the outer core that is opposite to the facing surface.

Examples of materials of the compacting die set 1 include appropriate high-strength materials (high-speed steels or the like) that have heretofore been used to form a dust compact (mainly made of metal powder).

(Moving Mechanism)

The die and at least one of the paired punches are movable relative to each other. In the compacting die set 1 illustrated in FIG. 1, the lower punch 12 is fixed to a body apparatus, which is not illustrated, and unable to move, while the die 10A and the upper punch 11 can be vertically moved by a moving mechanism, which is not illustrated. Other usable configurations include one in which both punches 11 and 12 are movable while the die 10A is fixed, and one in which the die 10 and the punches 11 and 12 are all movable. By fixing one of the punches (lower punch 12, here), the moving mechanism is prevented from being complex, and thus a moving operation can be easily controlled.

Allowing the die to move relative to at least one punch facilitates removal of a dust compact from the die.

<Additional Information>

In the manufacturing method according to the present invention, a lubricant may be applied to the compacting die set (the inner circumference of the die, in particular). Examples that are usable as lubricants include solid lubricants and liquid lubricants, examples of the solid lubricants including metallic soap such as lithium stearate, fatty acid amide such as octadecanamide, and higher fatty acid amide such as ethylenebisstearamide, and examples of the liquid lubricants including liquid dispersion obtained by dispersing a solid lubricant into a liquid medium such as water. It should be noted, however, as the amount of usage of the lubricant (thickness of applied lubricant) decreases, a dust compact having a high proportion of the content of the magnetic component can be obtained.

Here, the case where each of the upper punch 11 and the lower punch 12 is a single unit is illustrated, as in the case of FIG. 1. However, at least one of the upper punch and the lower punch may be constituted by multiple components. In this case, the components may be configured so as to be movable independently of each other.

[Preparing Step]

In the preparing step, coated soft magnetic powder, which is raw-material powder of the outer core, is prepared. The coated soft magnetic powder includes a plurality of coated soft magnetic particles formed by coating the outer circumference of soft magnetic particles with insulating coated films.

{Soft Magnetic Particle}

(Composition)

A material containing 50 wt % or higher of iron is preferable for soft magnetic particles. For example, at least one ferroalloy selected from an iron (Fe)-silicon (Si)-based alloy, an iron (Fe)-aluminum (Al)-based alloy, an iron (Fe)-nitrogen (N)-based alloy, an iron (Fe)-nickel (Ni)-based alloy, an iron (Fe)-carbon (C)-based alloy, an iron (Fe)-boron (B)-based alloy, an iron (Fe)-cobalt (Co)-based alloy, an iron (Fe)-phosphorus (P)-based alloy, an iron (Fe)-nickel (Ni)-cobalt (Co)-based alloy, and an iron (Fe)-aluminum (Al)-silicon (Si)-based alloy is usable. Using such a ferroalloy facilitates a reduction in eddy current loss and a reduction in loss in a reactor. Particularly, pure iron containing 99 wt % or higher of iron (Fe) is preferable from the view point of magnetic permeability and a flux density.

(Particle Diameter)

It is sufficient that the average particle diameter of the soft magnetic particles only be of such a value that a dust compact made of the soft magnetic particles contributes to reduction in loss. In other words, the average particle diameter may be appropriately selected without any particular limitation, but is preferably 1 μm or larger but not larger than 150 μm, for example. By using the soft magnetic particles having the average particle diameter of 1 μm or larger, an increase in the coercive force and the hysteresis loss of the dust compact made of the soft magnetic powder can be suppressed without degrading the fluidity of the soft magnetic powder. By using the soft magnetic particles having the average particle diameter of 150 μm or smaller, on the other hand, an eddy current loss that occurs at high frequencies of 1 kHz or higher can be effectively reduced. More preferable average particle diameter of the soft magnetic particles is 40 μm or larger but not larger than 100 μm. Using the soft magnetic particles having the lower limit of the average particle diameter of 40 μm or larger brings about an effect of reducing an eddy current loss and facilitates handling of the coated soft magnetic powder, thereby achieving a high-density compact. The average particle diameter of the soft magnetic particles is a particle diameter obtained by arranging the diameters of particles in order from particles having a smaller diameter in a particle diameter histogram until the sum of mass of the measured particles reaches 50% of the gross mass and determining the particle diameter at that point, i.e., the average particle diameter is a 50% mass particle diameter.

(Shape)

The soft magnetic particles preferably have such a shape that an aspect ratio of the soft magnetic particles ranges from 1.2 to 1.8. The aspect ratio here is a ratio between the maximum diameter and the minimum diameter of each particle. When the soft magnetic particles whose aspect ratio falls within the above range are used to make a dust compact, the dust compact can have a larger demagnetizing factor and more excellent magnetic properties than a dust compact made of soft magnetic particles having a smaller aspect ratio (nearly 1.0). Moreover, the strength of the dust compact can be improved.

(Manufacturing Method)

Soft magnetic particles manufactured by atomizing method, such as water-atomizing method or gas-atomizing method, are preferable. Soft magnetic particles manufactured by water-atomizing method each have a large number of projections and depressions on its surface. The projections and depressions of different soft magnetic particles mesh with one another and thus a compact having a high strength is more likely to be obtained. On the other hand, soft magnetic particles manufactured by gas-atomizing method each have a substantially spherical shape, and are preferable because the soft magnetic particles have a smaller number of projections and depressions that may break the insulating coated films. A natural oxide may be formed on the surface of each soft magnetic particle.

{Insulating Coated Film}

Each insulating coated film covers the corresponding soft magnetic particle to insulate the soft magnetic particle from adjacent soft magnetic particles. Covering the soft magnetic particles with the insulating coated films prevents the soft magnetic particles from contacting one another, thereby reducing a relative magnetic permeability of the compact. In addition, the presence of the insulating coated films prevents an eddy current from flowing between the soft magnetic particles, thereby reducing an eddy current loss in the dust compact.

(Composition)

The insulating coated films are not particularly limited but they have to be excellent in terms of insulating properties in order to securely insulate the soft magnetic particles from one another. Examples of materials of the insulating coated films include phosphate, titanate, silicone resin, and a double layer made of phosphate and silicone resin.

Particularly, the insulating coated films made of phosphate have an excellent deformability. If the soft magnetic particles are deformed while a dust compact is manufactured by applying pressure to the soft magnetic material, the insulating coated films can be easily deformed so as to follow deformation of the soft magnetic particles. Moreover, the insulating coated films made of phosphate have a property with which the insulating coated films closely adhere to soft magnetic particles made of a ferrous material, and thus is less likely to be detached from the surface of the soft magnetic particles. Examples usable as phosphate include phosphate metallic salt compounds such as iron phosphate, manganese phosphate, zinc phosphate, or calcium phosphate.

If insulating coated films are made of a silicone resin, the insulating coated films have a high heat resistance. Thus, the insulating coated films are less likely to be decomposed in a heating step, which will be described later. Consequently, the soft magnetic particles can be favorably kept being insulated from one another until forming of a dust compact is complete.

In the case where the insulating coated film has a double-layer structure including a phosphate layer and a silicone resin layer, it is preferable that phosphate be placed on the side facing the soft magnetic particle and that silicone resin directly cover phosphate. Since silicone resin directly covers phosphate, the insulating coated film can obtain properties of both phosphate and silicone resin.

(Film Thickness)

The average thickness of the insulating coated films only has to be large enough for the insulating coated films to insulate adjacent soft magnetic particles from one another. For example, the average thickness is preferably 10 nm or larger but not larger than 1 μm. Use of the insulating coated films having a thickness of 10 nm or larger can prevent the soft magnetic particles from contacting one another and thus can effectively prevent energy loss due to an eddy current. Use of the insulating coated films having a thickness of 1 μm or smaller prevents the ratio of the content of the insulating coated films in the coated soft magnetic particles from being excessively large and thus can prevent a considerable reduction in the flux density of the coated soft magnetic particles.

The thickness of the insulating coated film can be determined in the following manner. The thickness of the insulating coated film is an average value obtained by firstly deriving a value corresponding to the thickness of the insulating coated film in consideration of a film composition obtained through a composition analysis (using transmission electron microscope energy dispersive X-ray spectroscopy (TEM-EDX)) and an element content obtained by the inductively coupled plasma-mass spectrometry (ICP-MS), and then by confirming and determining the order of the corresponding value of the thickness that has been derived in advance as being an appropriate value by directly observing the insulating coated film through a TEM image.

(Coating Method)

The method of coating soft magnetic particles with insulating coated films may be appropriately selected. Examples of the coating method include hydrolysis and condensation polymerization reaction. The soft magnetic particles and the material for making the insulating coated films are combined and the combination is mixed while being heated. With this operation, the soft magnetic particles can be fully dispersed into the material for the insulating coated films and the outer circumference of each soft magnetic particle can be coated with the insulating coated film.

The heating temperature and the mixing duration may be appropriately selected. By selecting the heating temperature and the number of times of rotation of a mixer, the soft magnetic particles can be fully dispersed, and covering of each particle with the insulating coated film is facilitated.

[Compacting Process]

In the compacting process, the coated soft magnetic powder is compacted by using the compacting die set 1. In this process, a compacting space 31 defined by the lower punch 12 and the tubular die 10A of the die set 1 is filled with the coated soft magnetic powder, which is raw-material powder P for making the outer core. Then, the coated soft magnetic powder in the compacting space 31 is compacted by the upper punch 11 and the lower punch 12.

{Compacting Procedure}

(Filling Step)

First, as illustrated in part (A) of FIG. 1, the upper punch 11 is moved to a predetermined stand-by position that is above the through hole 10*b* of the die 10A. In addition, the die 10A is moved upward so that a predetermined compacting space 31 is defined by the top surface 12*u* of the lower punch 12 and the through hole 10*b* of the die 10A. At this time, the lower punch 12 is positioned at an appropriate position considering the distance over which the die 10A will descend when the die 10A is pressed in the subsequent pressure applying step. Here, the lower punch 12 is positioned such that the top surface 12*u* of the lower punch 12 is positioned in the small rectangular hole 10*r* of the die 10A a certain distance away from the upper end of the small rectangular hole 10*r* toward the lower opening side of the die 10A, the certain distance being equivalent to the distance over which the die 10A descends in the pressure applying step.

The above-described coated soft magnetic powder is prepared as raw-material powder. As illustrated in part (B) of FIG. 1, the prepared raw-material powder P is fed into the compacting space 31, which is defined by the die 10A and the lower punch 12, by a powder feeding apparatus, which is not illustrated.

(Pressure Applying Step)

As illustrated in part (C) of FIG. 1, the upper punch 11 is moved downward and inserted into the large rectangular hole 10*p* of the through hole 10*b* of the die 10A, so that the raw-material powder P is pressed and compressed by the two punches 11 and 12.

A compacting pressure may be appropriately selected, but preferably and approximately ranges from 490 MPa to 1,470 MPa, or more specifically from 588 MPa to 1,079 MPa in order to manufacture a dust compact for use as a reactor core, for example. When the compacting pressure is 490 MPa or higher, the raw-material powder P can be fully compressed and a relative density of the outer core can be increased. When the compacting pressure is 1,470 MPa or lower, it is possible to suppress damaging of the insulating coated films due to a contact between the coated soft magnetic particles constituting the raw-material powder P.

The die 10A is caused to descend in the pressure applying step. When the pressure applying step is finished, the top surface 12*u* of the lower punch 12 is positioned at the upper end of the small rectangular hole 10*r* of the die 10A.

(Removing Step)

After performing the predetermined pressure applying step, the die 10A is moved relative to the compact 41, as illustrated in part (D) of FIG. 1. Here, the compact 41 is not moved, but only the die 10A is moved downward. At this time, part of the outer circumference of the compact 41 that has been in contact with the die 10A is rubbed by the through hole 10*b* of the die 10A due to a reaction force against the die 10A.

The die 10A is moved down until the top surface 10*u* of the die 10A is flush with the top surface 12*u* of the lower punch 12 or until the top surface 12*u* of the lower punch 12 comes above the top surface 10*u* of the die 10A. When the compact 41 is completely exposed outside the die 10A, the upper punch 11 is moved upward as illustrated in part (E) of FIG. 1. Here, the die 10A is moved while the compact 41 is sandwiched by the bottom surface 11*d* of the upper punch 11 and the top surface 12*u* of the lower punch 12, and the upper punch 11 is moved in the subsequent step. However, the upper punch 11 may be moved upward at the same time when the die 10A is moved, or the upper punch 11 may be moved before the die 10A is moved.

By moving the upper punch 11, the compact 41 becomes removable. Then, the compact 41 can be collected using a manipulator, for example.

In the case where the compacting process is consecutively performed, after a compact 41 is removed from the compacting die set 1 for forming a subsequent compact, the step of defining a compacting space, the step of filling the compacting space with the raw-material powder, the pressure applying step, and the removing step should be repeated in the above described manner.

The compact 41 that has been manufactured via the above process has a shape formed by using the inner circumferential shape of the die 10A, the shape of the bottom surface 11*d* of the upper punch 11, and the shape of the top surface 12*u* of the lower punch 12. In other words, as illustrated in part (F) in FIG. 1, the compact 41 is a substantially bow-shaped (bow-like) pillar in which an upper side of FIG. 1 serves as a chord, the opposite side (lower side of FIG. 1) serves as an arc, and the arc is partially cut so as to have a side parallel with the chord. This compact 41 is used as an outer core that is to be mounted on a reactor. In this compact 41, an electrically conductive portion in which soft magnetic particles conduct electricity between one another is less likely to be formed on the facing surface, which is formed by being pressed by the upper punch 11, because the facing surface is not rubbed by the die set in the pressure applying step or the removing step.

<Another Step>

It is preferable to perform a heating step, as another step, for heating the compact after the compacting process in order to remove distortion applied to the soft magnetic particles in the compacting process.

The higher the heating temperature in the heating step, the more satisfactorily the distortion can be removed. Thus, the heating temperature is preferably 300° C. or higher, particularly, 400° C. or higher. From the viewpoint of suppressing thermal decomposition of the insulating coated films covering the soft magnetic particles, the upper limit of the heating temperature is set to approximately 800° C. At the above-described heating temperature, the distortion applied to the soft magnetic particles in the pressure applying step can be removed, and thereby hysteresis loss of the compact can be effectively reduced.

The duration of the heating step may be appropriately selected depending on the heating temperature and the volume of the compact so that the distortion applied to the soft magnetic particles in the compacting process can be fully removed. For example, when the heating temperature falls within the above range, the duration preferably ranges from ten minutes to one hour.

The heating step may be performed in air atmosphere, but it is particularly preferable that the heating step is performed in inert gas atmosphere. Thus, the coated soft magnetic particles are prevented from being oxidized by oxygen in the air.

<<Operations and Effects>>

The above-described embodiment has the following effects.

(1) With the above manufacturing method, in the compacting process, the upper punch presses the facing surface of the outer core, which faces the inner core when a reactor is assembled. Thus, the facing surface is not rubbed by the die in the pressure applying step or the removing step. Consequently, the insulating coated films of the coated soft magnetic powder on the facing surface are less likely to be damaged, and an electrically conductive portion in which the soft magnetic particles conduct electricity between one another is less likely to be formed on the facing surface. Specifically, since an electrically conductive portion is less likely to be formed on the facing surface, an eddy current is less likely to occur over the facing surface when a reactor is assembled such that the facing surface extends perpendicularly to the magnetic flux direction and a coil is excited, thereby reducing an eddy current loss. In conclusion, with the above manufacturing method, an outer core that is effective in reducing loss in a reactor can be manufactured.

(2) The outer core manufactured by the above manufacturing method is effective in reducing loss in a reactor, and thus a low-loss reactor can be achieved.

<<Modifications>>

Modifications of the manufacturing method according to Embodiment 1 will be described below. The compacting die set 1 used in the manufacturing method may include an upper punch 11, a lower punch 12, and a die 10A having appropriately selected shapes with which the compacting die set 1 can mold an outer core that, when viewed in plan, has a shape in which a side of the outer core that is opposite to a facing side of the outer core, which faces the inner cores, has a smaller dimension in the width direction, which is parallel with the facing surface of the outer core, than the facing side. In Modifications to be described below, portions that differ from those in Embodiment 1, such as the shape of a portion of the compacting die set, will be described.

[Modification 1]

Figure 2:
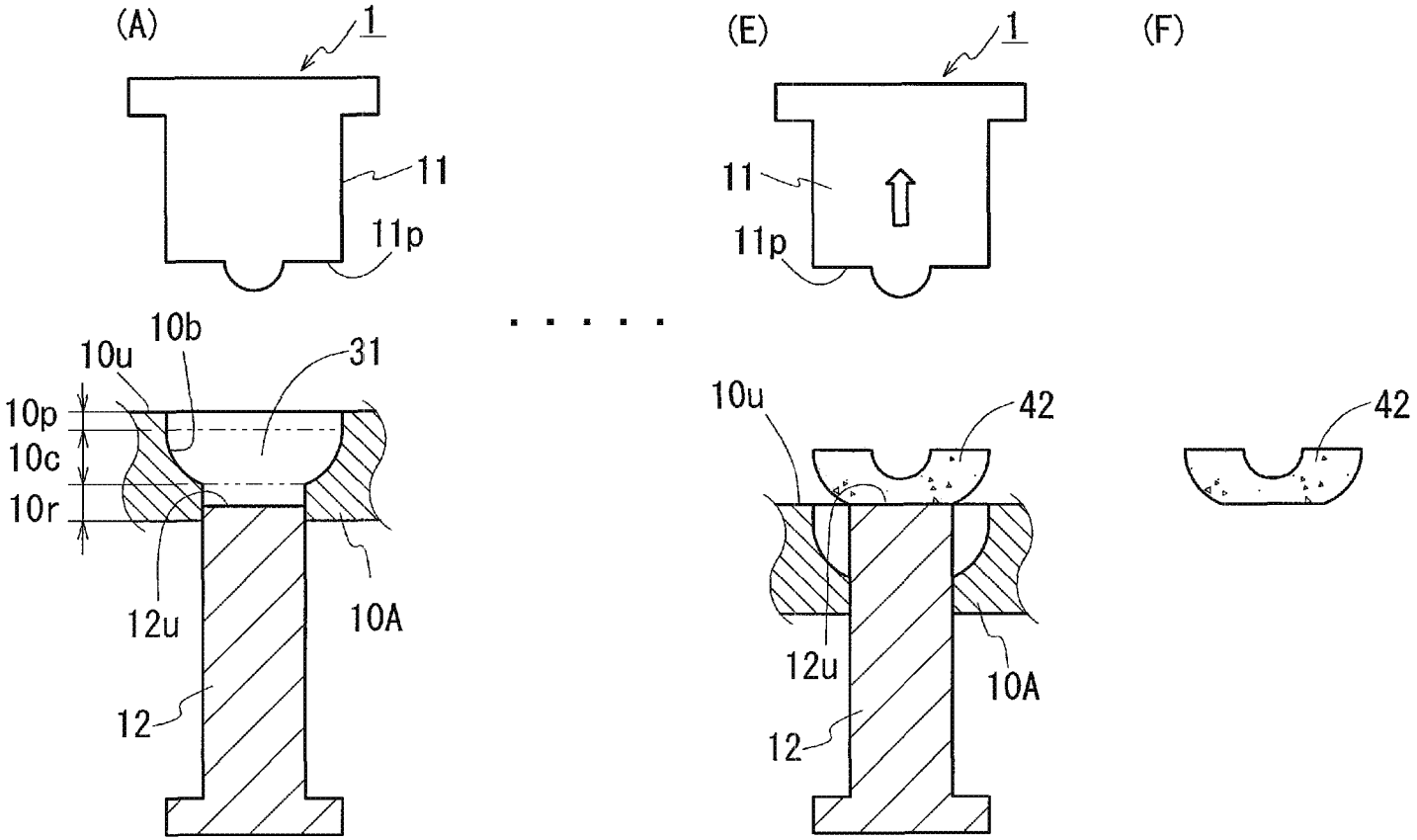
FIG. 2 schematically illustrates a process of exemplary steps in an outer core manufacturing method according to Modification 1.

Modification 1 differs from Embodiment 1 in terms of the shape of the upper punch 11 of the compacting die set 1 used for forming an outer core, as illustrated in part (A) of FIG. 2. The shapes of the die 10A and the lower punch 12 are the same as those in Embodiment 1. The portion that is different from that in Embodiment 1 will be described below.

(Upper Punch)

In Modification 1, an upper punch 11 having a protrusion is used as the upper punch 11 of the compacting die set 1 as illustrated in part (A) of FIG. 2, the protrusion protruding from a center portion, in the width direction (left-right directions of FIG. 2), on the bottom surface 11*p* of the upper punch 11 toward the lower punch 12 in the depth direction (vertical direction of FIG. 2).

By using the upper punch having the above shape, a compact 42 is formed by the same compacting process as that performed in Embodiment 1. Then, as illustrated in part (E) of FIG. 2, the upper punch 11 is moved upward to remove the compact 42.

As illustrated in part (F) of FIG. 2, the compact 42 thus manufactured has the same shape as a substantially U-shaped (U-like) pillar that opens upward of FIG. 1 and the side opposite to the opening is partially cut so as to have a side parallel with a flat area on the opening side. This compact 42 is used as an outer core that is to be mounted on a reactor. When the compact 42 is mounted on the reactor, the compact 42 is disposed such that the flat areas on the opening side of the compact 42 are connected to the inner cores. Here, the vicinities of the connection areas of the compact 42 (outer core) may be circumferentially covered by the coil.

[Modification 2]

Figure 3:
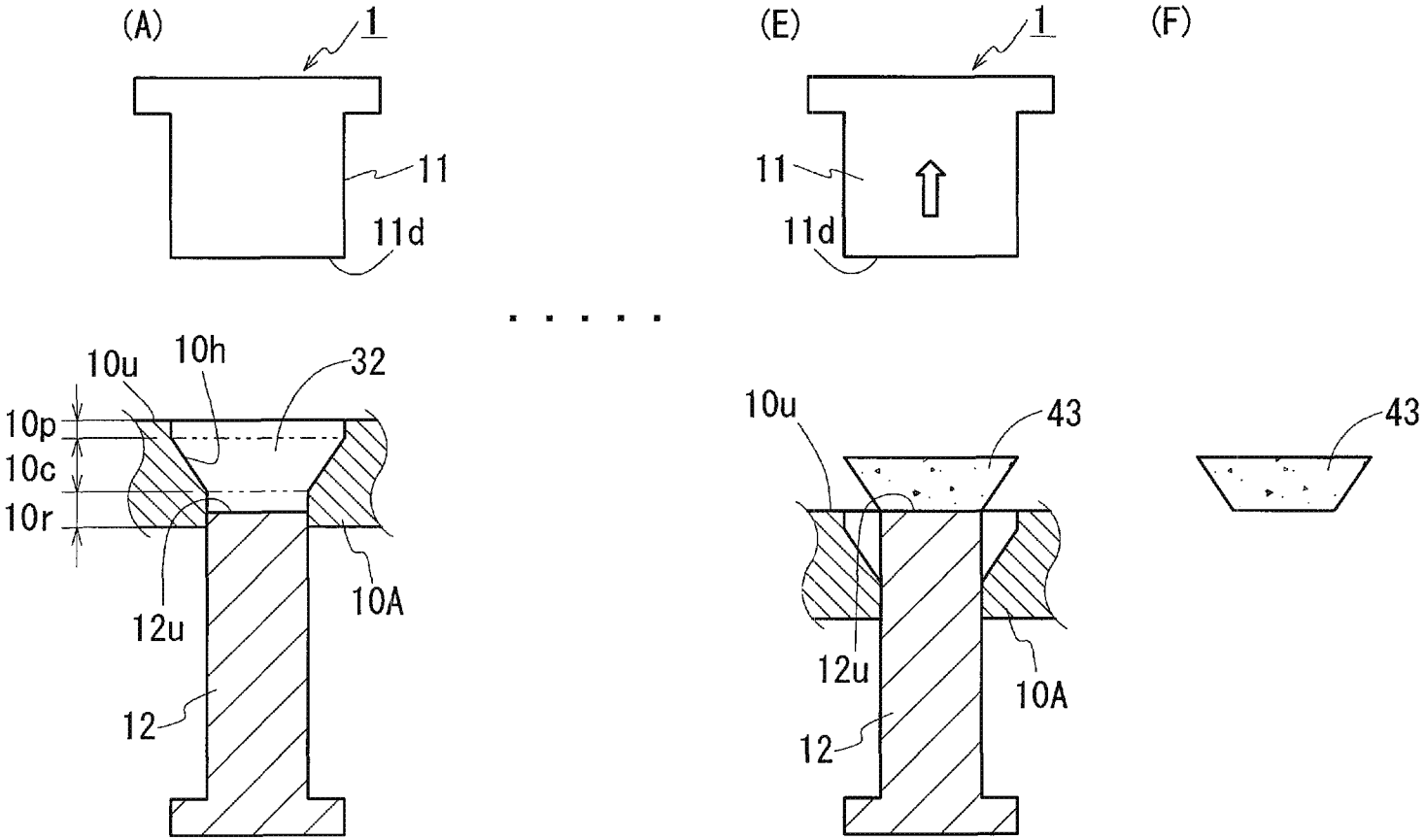
FIG. 3 schematically illustrates a process of exemplary steps in an outer core manufacturing method according to Modification 2.

As illustrated in FIG. 3, Modification 2 differs from Embodiment 1 in terms of the inner circumferential shape of the through hole 10*h* of the die 10A of the compacting die set 1 used for forming an outer core. The shapes of the upper and lower punches 11 and 12, however, are the same as those in Embodiment 1. The portion that is different from that in Embodiment 1 will be described below.

(Die)

In Modification 2, a die 10A having the following inner circumferential shape (of the tapering hole 10*c*) is used as the die 10A of the compacting die set 1. Specifically, the inner circumferential shape is a trapezoid (trapezoid-like shape) that has a longer base on the side facing the top surface 10*u* of the die 10A (the lower end of the large rectangular hole 10*p*) and a shorter base on the side facing the lower punch 12 (the upper end of the small rectangular hole 10*r*).

By using the die 10A having the above shape, a compact 43 is formed by the same compacting process as that performed in Embodiment 1. Then, as illustrated in part (E) of FIG. 3, the upper punch 11 is moved upward to remove the compact 43.

As illustrated in part (F) of FIG. 3, the compact 43 thus manufactured has the same shape as a trapezoidal (trapezoid-like) pillar that has a longer base on the upper side of FIG. 3 and a shorter base on the lower side of FIG. 3 and the bases are parallel with each other. This compact 43 is used as an outer core that is to be mounted on a reactor. When the compact 43 is mounted on a reactor, the compact 43 is disposed such that the longer-base side of the compact 43 faces the inner cores mounted on the reactor. End surfaces of the inner cores separately face left and right portions of the facing surface of the compact 43, of FIG. 3, the facing surface being on the longer-base side.

[Modification 3]

In Modification 3, in comparison with the outer core (see FIG. 1) of Embodiment 1, description will be given on a method of manufacturing an outer core that includes at least one of a facing-surface-side rectangular portion, in which the facing surface serves as a long side, and an opposite-side rectangular portion, in which the surface that is opposite to and parallel with the facing surface serves as a long side. As illustrated in part (A) of FIG. 4, Modification 3 differs from Embodiment 1 in terms of the shape of the die 10A and the position of the top surface 12*u* of the lower punch 12 relative to the die 10A, among various points of the compacting die set 1 used for forming an outer core. However, the shapes of the upper punch 11 and the lower punch 12 and the full thickness of the compact to be formed are the same as those in Embodiment 1. The portions that are different from those in Embodiment 1 will be described below. Here, for convenience of illustration, the full thicknesses of the die 10A and the compact 44 and the thicknesses of the rectangular bodies are exaggerated in FIG. 4.

(Die)

Figure 4:
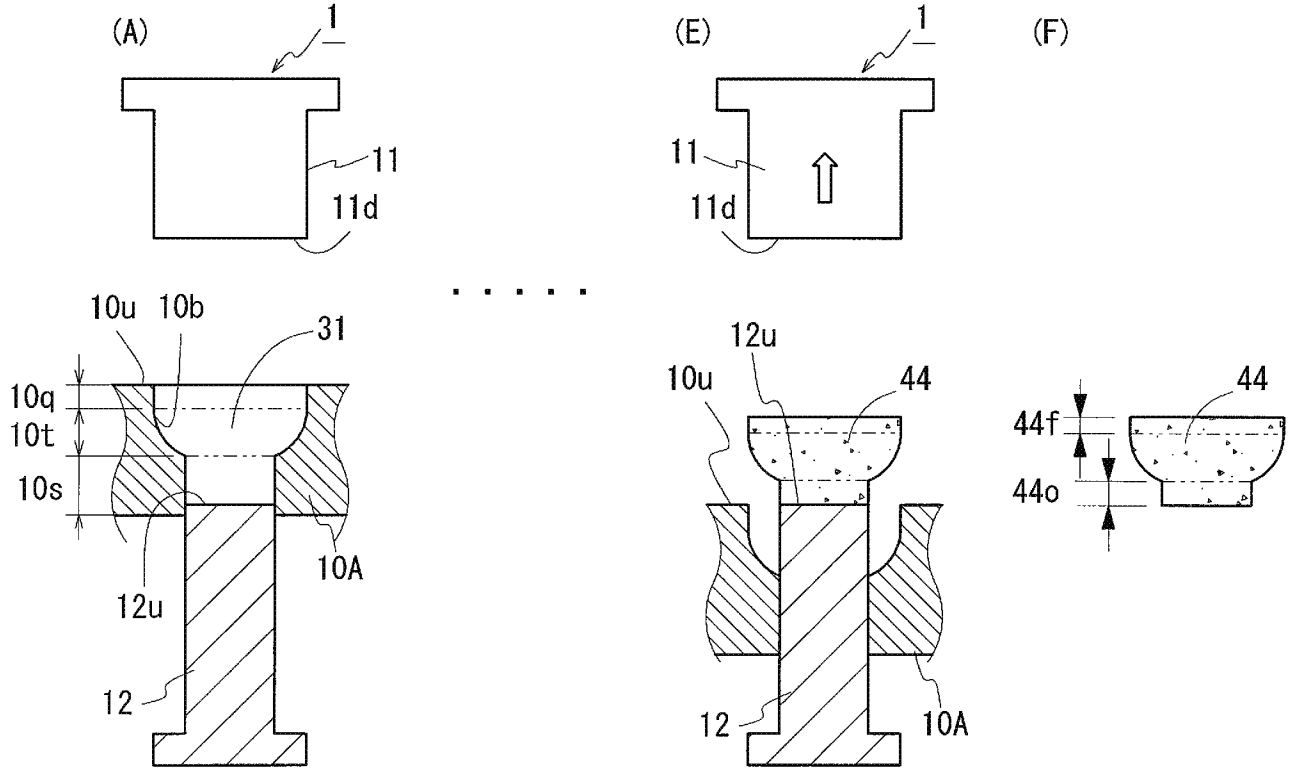
FIG. 4 schematically illustrates a process of exemplary steps in an outer core manufacturing method according to Modification 3.

As illustrated in part (A) of FIG. 4, in Modification 3, a die that has a large rectangular hole 10*q* having a larger thickness (up-down directions of FIG. 4) than that in Embodiment 1 is used as the die 10A. Since the large rectangular hole 10*q* has a larger thickness, the position of the bottom surface 11*d* of the upper punch 11 relative to the die 10A is above the lower end of the large rectangular hole 10*q* at the completion of the pressure applying step. Thus, the compact 44 includes a facing-surface-side rectangular portion 44*f* in which the facing surface serves as a long side and that has a thickness equivalent to the increased thickness of the large rectangular hole 10*q*, or, a thickness equivalent to the distance between the bottom surface 11*d* of the upper punch 11 and the lower end of the large rectangular hole 10*q*. In other words, the thickness of the facing-surface-side rectangular portion 44*f* (part F of FIG. 4) is appropriately adjustable by changing the thickness of the large rectangular hole 10*q*, or more specifically, by changing the distance between the bottom surface 11*d* of the upper punch 11 and the lower end of the large rectangular hole 10*q*. Thus, the thickness (depth) of the large rectangular hole 10*q* may be appropriately selected depending on a desired thickness of the facing-surface-side rectangular portion 44*f*. For example, if the thickness of the large rectangular hole 10*q* of the die 10A is increased in order to increase the distance between the bottom surface 11*d* of the upper punch 11 and the lower end of the large rectangular hole 10*q*, the thickness of the facing-surface-side rectangular portion 44*f* can be increased. It is preferable to select the thickness of the large rectangular hole 10*q* such that the facing-surface-side rectangular portion 44*f* has a thickness of 0.3 mm or larger but not larger than 2.0 mm, or particularly, 0.5 mm or larger but not larger than 1.5 mm. When a die is manufactured so as to have a facing-surface-side rectangular portion 44*f* whose thickness is 0.3 mm or larger, the upper punch 11 can be fully prevented from abutting against a tapering hole 10*t* in the inner circumference of the die 10A. Moreover, when a die having the facing-surface-side rectangular portion 44*f* whose thickness is 2.0 mm or smaller is manufactured, an area on the facing surface side in which the coated soft magnetic powder is rubbed by the die in the pressure applying step or removing step can be reduced, thereby suppressing damage of the insulating coated films.

(Lower Punch)

In Modification 3, when the compacting space 31 is defined in the compacting die set 1 in the filling step, the lower punch 12 is positioned such that the position of the top surface 12*u* of the lower punch 12 relative to the die 10A is a certain distance away from the upper end of the small rectangular hole 10*s* toward the lower opening side of the die 10A, the certain distance being the sum of the distance over which the die 10A descends in the pressure applying step and the desired thickness of the opposite-side rectangular portion 44*o* of the compact 44 to be manufactured. The thickness of the opposite-side rectangular portion 44*o* (part F of FIG. 4) of the manufactured compact 44 is appropriately adjustable by changing the position of the top surface 12*u* of the lower punch 12 relative to the small rectangular hole 10*s*. Thus, the position of the top surface 12*u* of the lower punch 12 may be appropriately selected depending on the desired thickness of the opposite-side rectangular portion 44*o*. For example, when the position of the top surface 12*u* of the lower punch 12 relative to the die 10A is determined at a position near the upper end of the small rectangular hole 10*s*, the thickness of the opposite-side rectangular portion 44*o* can be decreased. On the other hand, when the position of the top surface 12*u* of the lower punch 12 relative to the die 10A is determined at a position near the lower end of the small rectangular hole 10*s* (lower opening side), the thickness of the opposite-side rectangular portion 44*o* can be increased. It is preferable that the position of the top surface 12*u* of the lower punch 12 be appropriately selected in this manner such that the thickness of the opposite-side rectangular portion 44*o* is 0.5 mm or larger but not larger than t/2, particularly 1.0 mm or larger but not larger than t/2, where "t" denotes the thickness of a portion of the manufactured compact 44 from the facing surface to the end surface opposite to the facing surface. When the compact 44 is manufactured so as to have an opposite-side rectangular portion whose thickness is 0.5 mm or larger, the lower punch 12 is fully prevented from entering the inner side of the die 10A beyond the small rectangular hole 10*s* in the pressure applying step. By manufacturing the compact 44 having the opposite-side rectangular portion 44*o* whose thickness is t/2 or smaller, the ratio of the opposite-side rectangular portion to the whole outer core can be prevented from being excessively large.

In the case where, as in the case of Modification 3, the compact 44 that includes both the facing-surface-side rectangular portion 44*f* and the opposite-side rectangular portion 44*o* is manufactured, it is preferable to perform compacting by appropriately selecting the distance between the lower end of the large rectangular hole 10*q* and the bottom surface 11*d* of the upper punch 11 and the distance between the upper end of the small rectangular hole 10*q* and the top surface 12*u* of the lower punch 12 such that the facing-surface-side rectangular portion 44*f* has a smaller thickness than the opposite-side rectangular portion 44*o*. Reducing the thickness of the facing-surface-side rectangular portion 44*f* can reduce an area of the compact on the facing-surface side that is disposed near the coil when the compact is mounted on a reactor and that is rubbed by the die 10A in the pressure applying step or the removing step, and thereby the insulating coated films of the compact can be prevented from being damaged. Consequently, an eddy current loss can be reduced.

By using the compacting die set 1, a compact 44 is formed by the same compacting process as that performed in Embodiment 1. At the completion of the pressure applying step, the position of the top surface 12*u* of the lower punch 12 relative to the die 10A is a certain distance away from the upper end of the small rectangular hole 10*s* toward the lower opening side of the die 10A, the certain distance being equivalent to the thickness of the opposite-side rectangular portion 44*o* of the compact 44. Then, as illustrated in part (E) of FIG. 4, the upper punch 11 is moved upward to remove the compact 44.

As illustrated in part (F) of FIG. 4, the compact 44 thus manufactured has a shape of a pillar including, from the upper side of FIG. 4 to the opposite side (lower side of FIG. 4), a facing-surface-side rectangular portion 44*f*, a substantially bow-like shape, and an opposite-side rectangular portion 44*o*. The facing-surface-side rectangular portion 44*f* is a rectangle whose long side extends in the width direction. The substantially bow-like shape is one in which the long side of the rectangle serves as a chord, a side opposite to the chord serves as an arc, and the arc is partially cut so as to have a side parallel with the chord. The opposite-side rectangular portion 44*o* is a rectangle in which the side formed by cutting the arc serves as a side of itself. This compact 44 serves as an outer core that is to be mounted on a reactor. This compact 44 is mounted on a reactor such that the surface formed by being pressed by the upper punch 11 serves as a facing surface.

[Modification 4]

Figure 5:
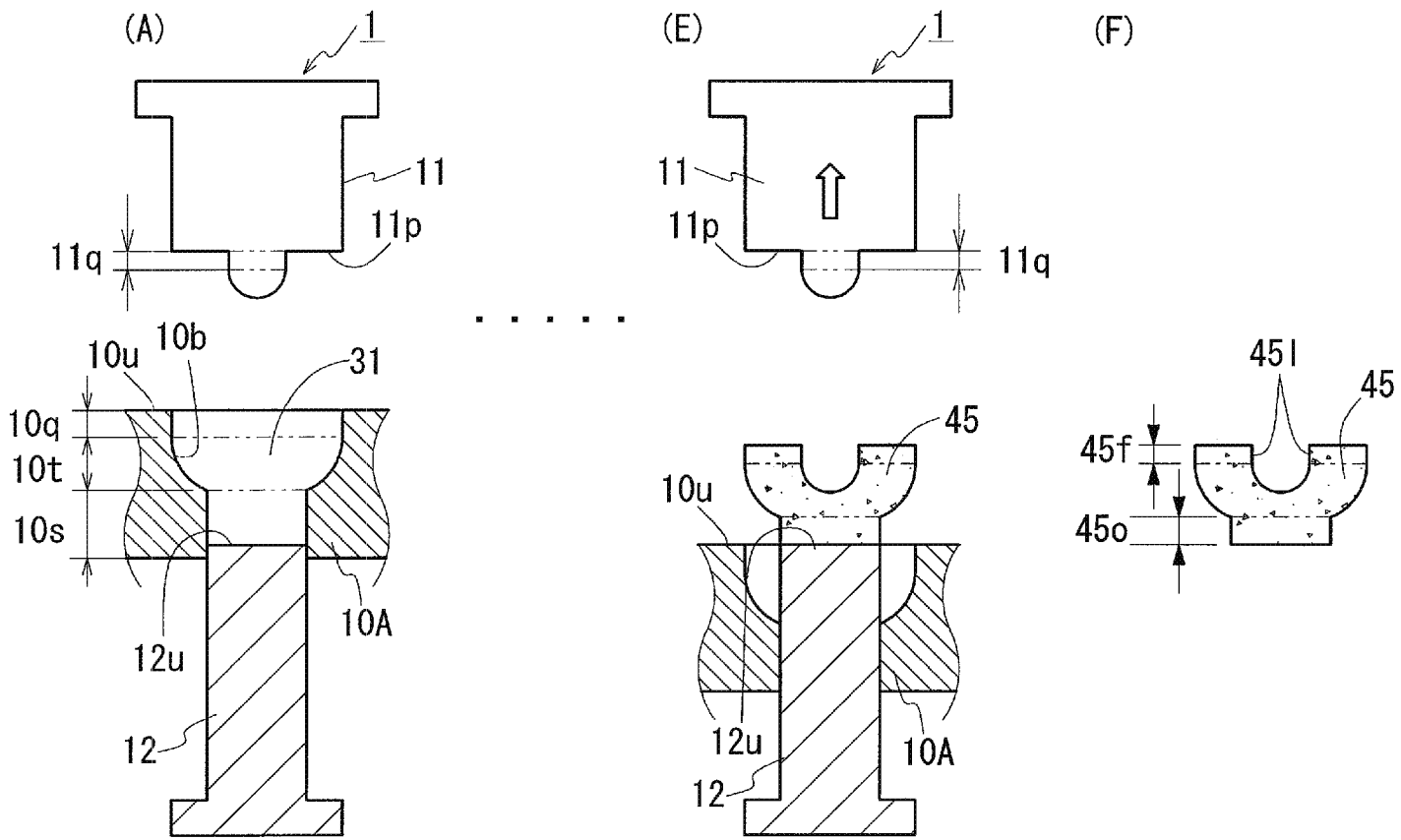
FIG. 5 schematically illustrates a process of exemplary steps in an outer core manufacturing method according to Modification 4.

As illustrated in part (A) of FIG. 5, Modification 4 is formed on the basis of the compacting die set 1 illustrated in Modification 1 and is similar to Modification 3 in terms of the thickness of the large rectangular hole 10*q* and the position of the top surface 12*u* of the lower punch 12 relative to the die 10A, while Modification 4 differs from Modification 1 in terms of the shape of part of the upper punch 11. Specifically, the large rectangular hole 10*q* has a larger thickness than those of Embodiment 1 and Modification 1. In addition, when the compacting space 31 is defined in the filling step, the top surface 12*u* of the lower punch 12 is positioned a certain distance away from the upper end of the small rectangular hole 10*s* toward the lower opening side, the certain distance being equivalent to the sum of the distance over which the die 10A descends in the pressure applying step and a desired thickness of the opposite-side rectangular portion 45*o* of a compact 45 to be manufactured. Points that are different from those of the Modification 1 will be described below.

(Upper Punch)

In Modification 4, an upper punch 11 having a protrusion protruding toward the lower punch 12 is used as in the case of Modification 1. As illustrated in FIG. 5, the protrusion has a shape that includes a rectangular portion 11*q*, which uniformly extends from the bottom surface 11*p* of the upper punch 11 toward the lower punch 12, and a bow shape, which is formed from the rectangular portion 11*q* toward the lower punch 12. The bow shape has a chord on the rectangular-portion-11*q* side, and an arc on the lower-punch-12 side. The rectangular portion 11*q* of the protrusion having a certain thickness (in the up-down directions of FIG. 5) forms straight areas 45*l* in the opening of a compact 45 (part (F) of FIG. 5) that has been manufactured. Thus, the length of the straight areas 45*l* can be appropriately selected by changing the thickness of the rectangular portion 11*q*.

By using the upper punch 11 having the above shape, a compact 45 is formed by the same compacting process as that performed in Embodiment 1. At the completion of the pressure applying step, the position of the top surface 12*u* of the lower punch 12 relative to the die 10A is a certain distance away from the upper end of the small rectangular hole 10*s* toward the lower opening side of the die 10A, the certain distance being equivalent to the thickness of an opposite-side rectangular portion 45*o* of the compact 45. Then, as illustrated in part (E) of FIG. 5, the upper punch 11 is moved upward to remove the compact 45.

As illustrated in part (F) of FIG. 5, the compact 45 thus manufactured has a shape of a pillar including a facing-surface-side rectangular portion 45*f*, a substantially-U-shaped portion, and an opposite-side rectangular portion 45*o*. The facing-surface-side rectangular portion 45*f* is a rectangle having an opening, which opens upward of FIG. 5, and the straight areas 45*l*. The substantially-U-shaped portion is one in which an opposite side, which is opposite to the facing-surface-side rectangular-portion-45*f* side, is partially cut such that the opposite side becomes parallel with a flat area on the opening side. The opposite-side rectangular portion 45*o* is a rectangle that uniformly protrudes from a side obtained by partially cutting the opposite side toward a side opposite to the partially-cut side. This compact 45 serves as an outer core that is to be mounted on a reactor. This compact 45 is mounted on a reactor such that the flat areas (connection areas) on the opening side of the compact 45 are connected to the inner cores. Here, the vicinities of the connection areas of the facing-surface-side rectangular portion 45*f* of the compact 45 (outer core) may be circumferentially covered by the coil, as in the case of Modification 1.

[Modification 5]

Figure 6:
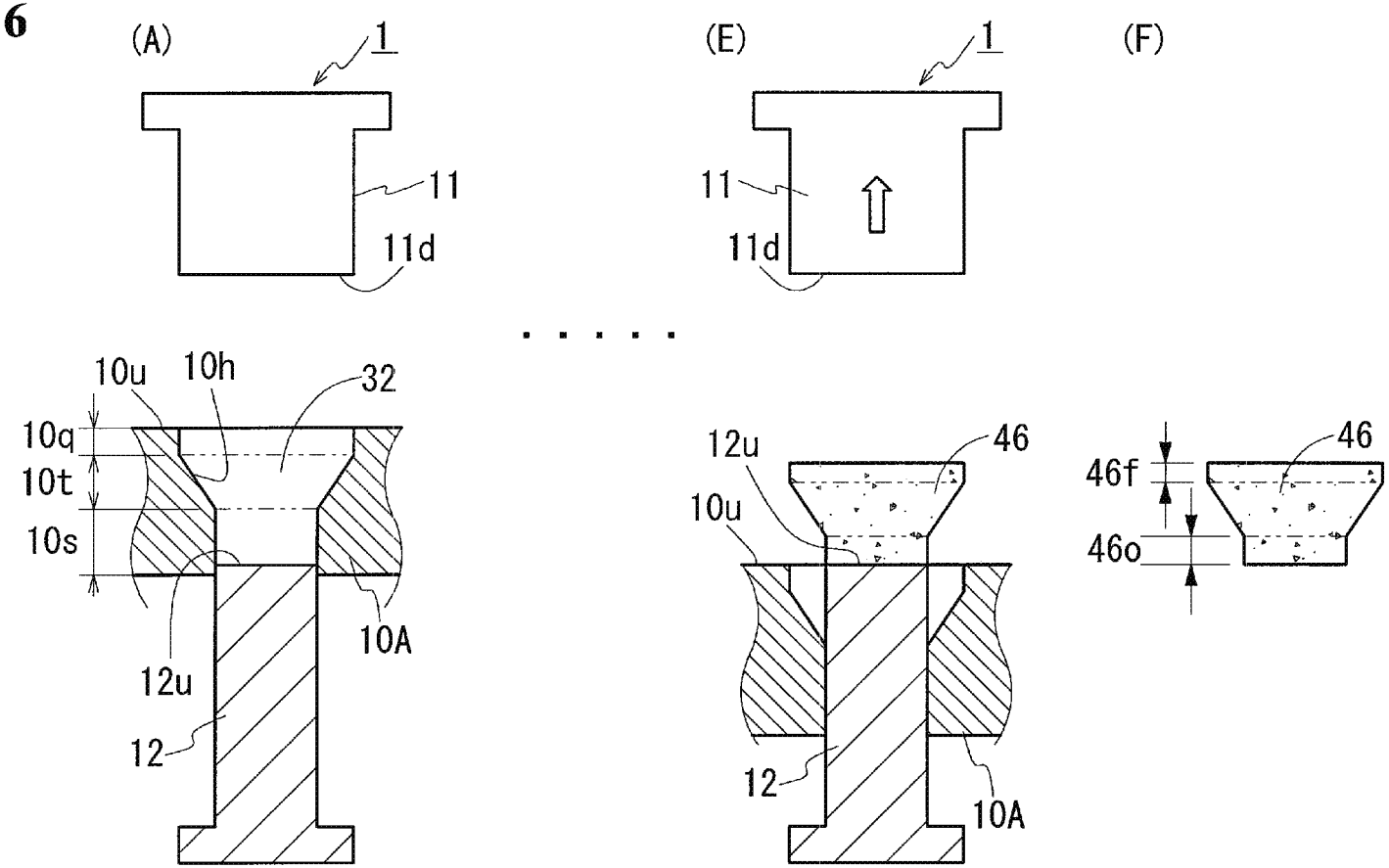
FIG. 6 schematically illustrates a process of exemplary steps in an outer core manufacturing method according to Modification 5.

As illustrated in part (A) of FIG. 6, Modification 5 is formed on the basis of the compacting die set 1 illustrated in Modification 2 and is similar to Modification 3 in terms of the thickness of the large rectangular hole 10*q* and the position of the top surface 12*u* of the lower punch 12 relative to the die 10A. Specifically, the large rectangular hole 10*q* has a larger thickness than that of Modification 2. In addition, when a compacting space 32 is defined in the filling step, the lower punch 12 is positioned such that the position of the top surface 12*u* of the lower punch 12 is a certain distance away from the upper end of the small rectangular hole 10*s* toward the lower opening side, the certain distance being equivalent to the sum of the distance over which the die 10A descends in the pressure applying step and a desired thickness of the opposite-side rectangular portion 46*o* of a compact 46 to be manufactured.

The compact 46 is formed by the same compacting process as that performed in Embodiment 1. At the completion of the pressure applying step, the position of the top surface 12*u* of the lower punch 12 relative to the die 10A is a certain distance away from the upper end of the small rectangular hole 10*s* toward the lower opening side of the die 10A, the certain distance being equivalent to the thickness of an opposite-side rectangular portion 46*o* of the compact 46. Then, as illustrated in part (E) of FIG. 6, the upper punch 11 is moved upward to remove the compact 46.

As illustrated in part (F) of FIG. 6, the compact 46 thus manufactured has a shape of a pillar including, from the upper side of FIG. 6 to the opposite side (lower side of FIG. 6), a facing-surface-side rectangular portion 46*f*, a trapezoid, and an opposite-side rectangular portion 46*o*. In the facing-surface-side rectangular portion 46*f*, the facing surface side serves as the long side. One of sides of the facing-surface-side rectangular portion 46*f* serves as the longer base of the trapezoid. A shorter base of the trapezoid serves as a side (long side) of the opposite-side rectangular portion 46*o*. This compact 46 serves as an outer core that is to be mounted on a reactor. When the compact 46 is mounted on a reactor, the compact 46 is disposed such that the longer side of the compact 46 faces the inner cores mounted on the reactor, as in the case of Modification 2. Specifically, end surfaces of the inner cores separately face left and right portions, of FIG. 6, of the facing surface on the longer side of the compact 46.

<<Operations and Effects>>

Compacts manufactured by using the punches and dies having the above-described shapes according to Modifications 1 to 5 are effective in reducing loss in a reactor, and thus can be preferably used as outer cores for a reactor. Manufacturing of a compact such that the compact includes a facing-surface-side rectangular portion prevents an upper punch from abutting against a tapering hole of the inner circumference of a die in the pressure applying step. Consequently, the compacting die set is less likely to be damaged and the life of the compacting die set is less likely to be reduced. Moreover, pressure can be easily applied to a compact in the pressure applying step, and thus a compact having a high density can be manufactured. In the case where a compact is manufactured such that the compact does not include an opposite-side rectangular portion, the top surface of the lower punch has to be strictly positioned at the upper end of the small rectangular hole after the completion of application of pressure in the pressure applying step in order to prevent the top surface of the lower punch from entering into the inner side (upper-punch side) of the die beyond the small rectangular hole. On the other hand, in the case where a compact is manufactured such that the compact includes an opposite-side rectangular portion, the top surface of the lower punch is positioned in the middle of the small rectangular hole after the completion of application of pressure. Thus, the lower punch can be fully prevented from entering into the inner side (upper-punch side) of the die relative to the die beyond the small rectangular hole. Thus, in the case where a compact is manufactured such that the compact includes an opposite-side rectangular portion, it is possible to prevent easily chipped acute corners from being formed at both widthwise end portions on the side opposite to the facing surface of the outer core without the top surface of the lower punch being constantly positioned as strictly as needed in the case where a compact is manufactured such that the compact does not include an opposite-side rectangular portion. In other words, the speed at which the compacting process is performed can be increased in consecutive compacting, and thus the productivity is improved.

Embodiment 2

Figure 8:
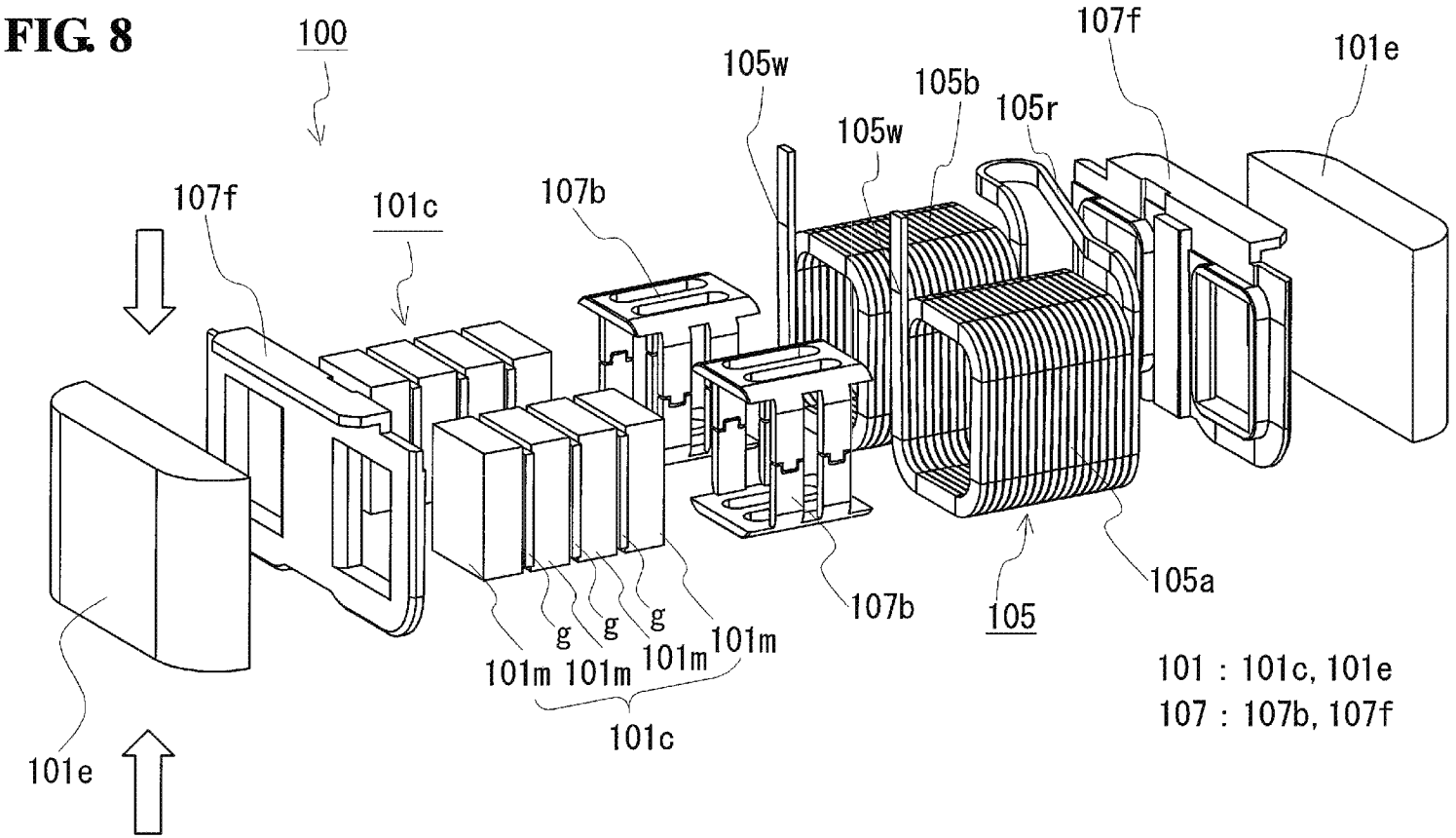
FIG. 8 is an exploded perspective view schematically illustrating components of the reactor according to Embodiment 2.

In Embodiment 2, description is given on an example of a reactor including outer cores manufactured by the above-described manufacturing method. In other words, the reactor according to the present invention is characterized in that outer cores manufactured by the above-described manufacturing method are used as outer cores included in a reactor. Other configurations are the same as an existing reactor illustrated with reference to FIGS. 7 and 8. Here, description will be given below also on portions that are the same as those of the existing reactor. A reactor that includes outer cores manufactured by the manufacturing method described in Embodiment 1 as outer cores is described as an example.

[Reactor]

As illustrated in FIG. 7, a reactor 100 includes a coil 105, inner cores 101*c* disposed inside the coil 105, and outer cores 101*e* exposed outside the coil 105 as main components. The expression "the outer cores 101*e* are exposed outside" here includes the case where the entirety of each outer core 101*e* is exposed outside and the case where a small portion of each outer core is surrounded by a turn as in the case where each outer core has a U shape.

[Coil]

A coil 105 includes a pair of coil elements 105*a* and 105*b* formed by helically winding a single continuous wire 105*w*. The coil elements 105*a* and 105*b* are arranged side by side such that their axial directions are parallel with each other. The coil elements 105*a* and 105*b* are formed by a single wire such that ends of the wire are positioned on a first end side of the coil 105 in the axial direction and a return portion 105*r* (FIG. 8) is positioned on a second end side of the coil 105 by bending the wire. A coated flat wire formed by coating a copper flat wire with enamel paint for insulation is used as the wire. The coil elements 105*a* and 105*b* are formed by winding the coated flat wire edgewise. Other wires such as those having circular and polygonal cross sections may be used as well as the flat wire. The pair of coil elements 105*a* and 105*b* may be formed separately and end portions of wires of the coil elements 105*a* and 105*b* may be connected by soldering or by other methods.

[Core]

A core 101 is an annular member including inner cores 101*c* and outer cores 101*e*.

Each inner core 101*c* is disposed at such a position that the coil is disposed around the outer circumference of the inner core 101*c*. Each inner core 101*c* includes core pieces 101*m*, which are magnetic bodies, and interleaving portions g, which are interposed between core pieces 101*m* for adjustment of inductance. A plate-shaped member made of a non-magnetic material such as alumina is usable as an interleaving material for the interleaving portions g. Each inner core 101*c* is formed by alternately stacking core pieces 101*m* and interleaving portions g one on top of another and bonding them together by a bonding agent or by other means. In Embodiment 2, the pair of inner cores 101*c* are arranged side by side. A dust compact formed by compacting coated soft magnetic powder containing iron or a stacked body formed by stacking multiple electromagnetic steel sheets one on top of another may be used as each core piece 101*m*.

The outer core 101*e* is a compact that is formed by compacting coated soft magnetic powder by the above-described manufacturing method. When seen in plan, the outer core 101*e* has a substantially bow-like shape (bow shape) having a chord and an arc. The chord side of the substantially bow-shaped (bow-like) outer core 101*e* is disposed so as to face the inner cores 101*c*. When a surface of each component of the reactor that faces a cooling base is defined as a base surface (bottom surface in FIGS. 7 and 8), the base surfaces of the outer cores 101*e* protrude downward (toward the cooling base) beyond the base surfaces of the inner cores 101*c* so as to be substantially level with the base surfaces of the coil elements 105*a* and 105*b*.

The core 101 is made so as to be annular by connecting the pair of inner cores 101*c* and the pair of outer cores 101*e*. Connection is achieved by using a bonding agent or the like. The cores 101*c* and 101*e* may be directly connected to one another, or may be indirectly connected to one another via interleaving members similar to the interleaving portions g. In Embodiment 2, four core pieces 101*m* and three interleaving portions g are used to form each inner core 101*c*. However, the number of sections that constitute the core 101 or the number of interleaving portions g may be appropriately selected.

<Insulator>

An insulator 107 is a member that secures insulation between the core 101 and the coil 105, and is used when needed. The insulator 107 includes tubular portions 107*b*, which individually cover the outer circumferences of the inner cores 101*c* of the core 101, and a pair of flanges 107*f*, which are brought into contact with end surfaces of the coil. Each tubular portion 107*b* can easily cover the outer circumference of the corresponding inner core 101*c* by joining rectangular tube halves to each other. The flanges 107*f* are a pair of rectangular frames that are arranged side by side and connected to each other. The flanges 107*f* are members that are disposed at end portions of the tubular portions 107*b*. Insulating resins such as polyphenylene sulfide (PPS) resin, liquid crystal polymer (LCP), polytetrafluoroethylene (PTFE) resin are usable for the insulator 107.

<<Operations and Effects>>

The reactor according to Embodiment 2 described above includes outer cores on whose facing surfaces, which face the inner cores, an eddy current is less likely to occur. Thus, the reactor can reduce an iron loss if the coil is excited with an alternating current of high frequency.

Test Example

Following specimens 1 to 4 were formed as test examples and tests were conducted to find the magnetic properties of each specimen. The tests will be described below.

[Specimen 1]

Iron powder having a purity of 99.8% or higher and manufactured by water-atomizing method was prepared as soft magnetic particles. The average particle diameter of the soft magnetic particles was 50 μm and the aspect ratio of the soft magnetic particles was 1.2. The average particle diameter was obtained by arranging the diameters of particles in order from particles having a smaller diameter in a particle diameter histogram until the sum of mass of the measured particles reached 50% of the gross mass and determining the particle diameter at that point, i.e., the average particle diameter was a 50% mass particle diameter. The metal particles were subjected to phosphating treatment to form insulating coated films made of iron phosphate on their surfaces, and thus coated soft magnetic particles were fabricated. Each insulating coated film covered substantially the entirety of the surface of the corresponding soft magnetic particle and the thickness of each insulating coated film was 20 nm on average. A group of coated soft magnetic particles was coated soft magnetic powder used as a constituent material of a compact.

A lubricant made of zinc stearate was added to the coated soft magnetic powder such that the content of the zinc stearate was 0.6 weight %, so that a mixture was formed. The mixture was inserted into a die (FIG. 1) having a predetermined shape illustrated in Embodiment 1, and a pressure of 588 MPa was applied to compact the mixture. Thus, a compact 41 having the shape illustrated in FIG. 1 was formed.

[Specimen 2]

The specimen 2 differed from the specimen 1 in terms of the shape of a compact when viewed in plan. Specifically, the specimen 2 was molded by using a compacting die set different from that for molding the specimen 1. Here, a compact having the same shape as the compact 44 illustrated in part (F) of FIG. 4 was formed by using a die set (FIG. 4) having a predetermined shape illustrated in Modification 3. By measuring the thickness of the compact thus formed, it was found that the full thickness of the compact 44 was 24 mm, the thickness of the facing-surface-side rectangular portion 44*f* was 1.5 mm, and the thickness of the opposite-side rectangular portion 44*o* was 10 mm.

[Specimen 3]

The specimen 3 was molded by using a die set having a shape similar to that for molding the specimen 2, but differed from the specimen 2 in terms of the thicknesses of the facing-surface-side rectangular portion 44*f* and the opposite-side rectangular portion 44*o* of the compact 44. Specifically, the specimen 3 was molded by using a compacting die set 1 that differed from the one for molding the specimen 2 in terms of the thickness of the large rectangular hole 10*q* and the position of the top surface 12*u* of the lower punch 12 relative to the die 10A. By measuring the thickness of the compact 44 thus formed, it was found that the full thickness of the compact 44 was 24 mm, the thickness of the facing-surface-side rectangular portion 44*f* was 5 mm, and the thickness of the opposite-side rectangular portion 44*o* was 1 mm.

[Specimen 4]

The specimen 4 differed from the specimen 1 in terms of surfaces that were pressed by punches. Specifically, the specimen 2 was a compact formed by the pressure-applying surfaces substantially perpendicular to the magnetic flux by the upper and lower punches (in directions of hollow arrows of FIG. 8) in a compacting process.

[Evaluation]

The specimens 1 to 4 formed by the above-described process and multiple rectangular parallelepiped dust compacts made of the same material and under the same conditions as those for the specimens were subjected to heat treatment in a nitrogen atmosphere at 400° C. for 30 minutes to obtain heat-treated specimens and dust compacts. The heat-treated specimens and dust compacts thus obtained were annularly assembled to form testing magnetic cores, and magnetic properties, which will be described below, of the testing magnetic cores were measured. At this time, each of the specimens 1 to 3 was annularly assembled with the corresponding rectangular parallelepipeds such that the pressed surface of each compact faces the rectangular parallelepipeds.

[Magnetic Property Test]

Coils (for all the specimens and having the same specifications) made of wires were disposed on the testing magnetic cores to form measurement components, whose magnetic properties were measured. An eddy current loss We (W) of the measurement components individually containing different specimens was measured by using an alternating-current (AC)-BH curve tracer under the excitation flux density Bm of 1 kG (=0.1 T) and at the measurement frequency of 5 kHz. The test results are shown in Table 1.

TABLE 1

| Specimen No. | Eddy current loss We (W) |
|---|---|
| 1 | 0.77 |
| 2 | 0.77 |
| 3 | 0.95 |
| 4 | 5.4 |

[Results]

An eddy current loss in each of the specimens 1 to 3 was smaller than that in the specimen 4. Since the specimens 1 to 3 were formed by applying pressure to the surfaces through which magnetic fluxes pass substantially orthogonal to the surfaces, the pressed surfaces were not rubbed by the die in the pressure applying step or removing step. For this reason, the insulating coated films of the coated soft magnetic powder, which is a constituent material of each specimen, on these surfaces were not damaged, and thus an electrically conductive portion, in which the soft magnetic particles conduct electricity between one another, was less likely to be formed. A reduction in eddy current loss was probably achieved as a result of an eddy current being less likely to occur on the pressed surfaces. The eddy current loss in the specimens 1 and 2 was smaller than that in the specimen 3, and the eddy current loss of the specimen 1 and the specimen 2 was on the same level. When the specimens 1 and 2 are compared with the specimen 3, the specimens 1 and 2 have scarcely any portion or only a small portion, on the facing surface side, that is rubbed by the die in the compacting process, or particularly in the removing step, since the specimen 1 does not have a facing-surface-side rectangular portion and the thickness of the facing-surface-side rectangular portion of the specimen 2 is smaller than that of the specimen 3. In other words, these results were obtained probably because the amount of damage sustained by the insulating coated films on the facing surface side disposed near the coil was reduced and an eddy current flowing in the circumferential direction in the specimens 1 and 2 was also reduced more than that in the specimen 3.

The present invention is not limited to the above-described embodiments, and can be changed as appropriate within a scope not departing from the gist of the invention. For example, compacts according to Modification 3 to 5 each include both the facing-surface-side rectangular portion and the opposite-side rectangular portion, but may only include one of these portions. Moreover, the opening of the compact 45 according to Modification 4 may not include straight areas 45*l* and may only include a curved area. In this case, the curved area may be formed by using an upper punch 11 having a protrusion having a bow shape in which part of the bottom surface 11*d* of the upper punch 11 serves as a chord and the lower-punch-12 side serves as an arc, as in the similar protrusion (FIG. 2) according to Modification 2.

INDUSTRIAL APPLICABILITY

The outer core according to the present invention is preferably applicable to a booster circuit for a hybrid car or other devices or to a reactor for an electric power station or substation. In addition, the outer core manufacturing method according to the present invention is preferably applicable to manufacturing of an outer core for a reactor. The reactor according to the present invention is usable as a component of devices including a power converter, such as a DC-DC converter, that is mounted on a vehicle such as a hybrid car, an electric car, or a fuel-cell-powered vehicle.

REFERENCE SIGNS LIST

1 compacting die set
10A die
10*b*, 10*h* through hole
10*u* top surface
10*p*, 10*q* large rectangular hole
10*r*, 10*s* small rectangular hole
10*c*, 10*t* tapering hole
11 upper punch
11*d*, 11*p* bottom surface
11*q* rectangular surface
12 lower punch
12*u* top surface
31, 32 compacting space
41, 42, 43, 44, 45, 46 compact
44*f*, 45*f*, 46*f* facing-surface-side rectangular portion
44*o*, 45*o*, 46*o* opposite-side rectangular portion
45*l* straight area
P raw-material powder
100 reactor
101 core
101*c* inner core
101*e* outer core
101*m* core piece
g interleaving portion
105 coil
105*a*, 105*b* coil element
105*w* wire
105*r* return portion
107 insulator
107*b* tubular portion
107*f* flange

The invention claimed is:

1. An outer core manufacturing method by which an outer core for a reactor is manufactured by performing compacting, the reactor including a coil, a pair of inner cores, and a pair of outer cores, the coil being formed by connecting a pair of coil elements to each other that are arranged side by side, the coil elements being formed by helically winding a wire, the pair of inner cores being individually disposed inside the coil elements, the pair of outer cores being exposed outside the coil, the pair of outer cores being connected to the inner cores to form an annular core together with the inner cores, the outer cores each having a facing surface that includes a connection area connected to the inner cores, the facing surface of one of the outer cores facing the other outer core with the inner cores interposed therebetween, each of the outer cores having the facing surface and an opposite surface, wherein the opposite surface is placed opposite to the facing surface and the opposite surface has a smaller area than the facing surface area, the method comprising:

a preparing step of preparing coated soft magnetic powder as raw-material powder of the outer core, the coated soft magnetic powder including a plurality of coated soft magnetic particles formed by coating soft magnetic particles with insulating coated films; and a compacting step of filling a compacting space, which is defined by a pillar-like first punch and a tubular die, with the coated soft magnetic powder and then compacting the coated soft magnetic powder in the compacting space by using the first punch and a pillar-like second punch that is disposed so as to face the first punch, the first punch and the die being movable relative to each other, wherein, in the compacting step, the facing surface of the outer core is pressed by the second punch and the opposite surface of the outer core is pressed by the first punch, and the tubular die has a through hole in which the dimension in the width direction of the tubular die on a first-punch side of the tubular die is smaller than that on a second-punch side of the tubular die.

2. The outer core manufacturing method according to claim 1, wherein the soft magnetic particles are made of pure iron.

3. The outer core manufacturing method according to claim 1, wherein the plan-view shape of each outer core is any one of:

(A) a bow shape in which the facing side of the outer core, which faces the inner cores, serves as a chord and the side of the outer core that is opposite to the facing side serves as an arc;

(B) a trapezoidal shape in which the facing side of the outer core, which faces the inner cores, serves as a longer base; and (C) a U shape that opens to the facing side of the outer core, which faces the inner cores.

4. The outer core manufacturing method according to claim 3, wherein the plan-view shape of the outer core further includes at least one of:

(D) a facing-surface-side rectangular portion in which an area of the facing surface that is parallel with a pressure-applying surface of the second punch serves as a long side of the facing-surface-side rectangular portion; and (E) an opposite-side rectangular portion in which a surface that is opposite to and parallel with the facing surface serves as a long side of the opposite-side rectangular portion.

5. The outer core manufacturing method according to claim 4, wherein a thickness of the facing-surface-side rectangular portion is 0.3 mm or larger but not larger than 2.0 mm.

6. The outer core manufacturing method according to claim 4, wherein a thickness of the opposite-side rectangular portion is 0.5 mm or larger but not larger than t/2 where t denotes a distance from the facing surface of the outer core to the surface of the outer core opposite to the facing surface.

7. The outer core manufacturing method according to claim 4, wherein a thickness of the facing-surface-side rectangular portion is smaller than a thickness of the opposite-side rectangular portion.

8. An outer core that is manufactured by the outer core manufacturing method according to claim 1.

9. A reactor comprising:

a coil formed by connecting a pair of coil elements to each other that are arranged side by side, the coil elements being formed by helically winding a wire;

inner cores individually disposed inside the coil elements; and outer cores exposed outside the coil, the outer cores each including a facing surface on a side that faces the inner cores, and the outer cores forming an annular core together with the inner cores, wherein each of the outer cores is the outer core according to claim 8.

* * * * *